United States Patent [19]

Dunn, Jr.

[11] 4,332,615

[45] Jun. 1, 1982

[54] PROCESS FOR BENEFICIATING A TITANIFEROUS ORE

[75] Inventor: Wendell D. Dunn, Jr., Lead, S. Dak.

[73] Assignee: Titanium Technology (Australia) Ltd., Sydney, Australia

[21] Appl. No.: 278,872

[22] Filed: Jun. 29, 1981

[51] Int. Cl.[3] ..... C22B 1/08; C22B 1/10

[52] U.S. Cl. ..... 75/1 TI; 423/74; 423/149

[58] Field of Search ..... 423/74, 76, 79, 149; 75/1 TI

[56] References Cited

U.S. PATENT DOCUMENTS

| | | | |
|---|---|---|---|
| 2,657,976 | 11/1953 | Rowe | 423/74 |
| 3,105,736 | 10/1963 | Groves | 423/74 |
| 3,144,303 | 8/1964 | Engelmann | 423/74 |
| 4,085,189 | 4/1978 | Dunn | 423/74 |

*Primary Examiner*—Brian E. Hearn

*Attorney, Agent, or Firm*—Abramo & Abramo

[57] ABSTRACT

Titaniferous ore is beneficiated to essentially pure titanium dioxide use in the production of titanium dioxide pigments by continuously chlorinating, in the presence of carbon and at high temperature, the ore in a first reactor wherein the iron content is maintained at about 3.5%, by weight, continuously passing the beneficiate-carbon mixture to a second reactor wherein the ratio of the diameters of the first reactor and the second reactor is in the range of 10:1 and wherein the beneficiate-carbon mixture is maintained at an iron content of about 0.1 to 1%, by weight, said beneficiate being continuously chlorinated while continuously removing the beneficiate and coke from the second reactor and continuously separating the product therefrom.

4 Claims, 2 Drawing Figures

Fig. 2. Stage I And Stage II $Fe/TiO_2$ Ratio

PROCESS FOR BENEFICIATING A TITANIFEROUS ORE

BACKGROUND OF THE INVENTION

1. Field of the Invention

The present invention relates to the field of titaniferous ore beneficiation and, more particularly, to an improved method for removing iron from a titaniferous ore by high temperature chlorination.

2. The Prior Art

Beneficiation methods employing high temperature chlorination have been faced with the problem of eliminating the iron oxide component in a titaniferous ore without losing titanium values in the course of producing a low iron beneficiate. Iron in the beneficiate causes a disposal problem as well as loss of chlorine in subsequent use to produce $TiCl_4$. Muskat, U.S. Pat. No. 2,184,884, sought to minimize titanium losses by restricting the reducing condition or using no reductant at all.

Fukushima, et al, U.S. Pat. No. 3,803,287 have employed low carbon and claimed a higher rate of reaction to attempt to accomplish this goal. A replacement beneficiate is made when iron values in the ore are replaced with $TiO_2$. Beneficiation by "replacement" is much more rapid and produces a more desirable harder product useful for producing titanium tetrachloride. The "replacement" beneficiate does not abrade as easily as a removal beneficiate to form fines or dust with a concomitant loss of titanium values. Formation of a "replacement" product involves generation in situ of $TiCl_4$ and its reaction with iron oxide, manganese oxide and magnesium oxide in the ore to deposit $TiO_2$ and volatilize these ore components as chlorides. Since $TiCl_4$, which is highly volatile, is being generated, there is a probability of its escape from the reaction zone. It is obvious that the rate of the replacement reaction controls whether any $TiCl_4$ will escape causing a loss of titanium values. I have found that the rate of replacement is a function of the iron oxide concentration in the bed and chlorination of beneficiate at extremely low iron levels will produce increasing $TiCl_4$ losses as lower iron levels are sought. Therefore, the problem exists of how to produce a low iron oxide containing titaniferous ore beneficiate without losing considerable quantities of titanium values. I have discovered a novel process for making such a product using staged reactors, one of which is smaller than the other.

SUMMARY OF THE INVENTION

A process for beneficiation of a titaniferous ore to a polycrystalline rutile having a low iron oxide content without the loss of appreciable titanium values as titanium tetrachloride comprising continuously adding a mixture of a particulate, titaniferous ore and carbon to a first stage gas-solids reactor containing a preformed bed of a partially beneficiated ore comprising particulate titaniferous ore and 10 to 25%, by weight, particulate carbon the ore having an iron oxide content of about 3.5%, by weight, as $Fe_2O_3$, said bed having a temperature of 900° to 1090° C., continuously injecting into the bed a gas selected from the group consisting of chlorine, chlorine and oxygen, chlorine and air, chlorine, oxygen and diluent gas, and chlorine, air and diluent gas, at a rate whereby in the first reactor the temperature is maintained, the bed is fluidized and iron oxide in the titaniferous ore is converted into iron chloride vapor, the iron content of the bed is maintained, and less than 2% of the chlorine values are converted to escaping $TiCl_4$; continuously transporting a portion of the bed of the first reactor to a second staged reactor at a rate which maintains constant bed depth in the first reactor, said second reactor containing therein a bed of particulate partially beneficiated ore and carbon wherein the iron content of the ore is in the range of 0.1–1.0%, by weight, calculated as $Fe_2O_3$; said second reactor bed having a temperature of 900° to 1090° C.; continuously injecting into the bed in the second reactor a reaction gas selected from the group consisting of chlorine, chlorine and oxygen, chlorine and air, chlorine, oxygen and a diluent gas, and chlorine, air and a diluent gas whereby in the second reactor the temperature is maintained, the bed is fluidized and iron oxide in the partially beneficiated ore is converted to an iron chloride vapor and substantial quantities of $TiCl_4$ are formed. The iron content of the bed in the second reactor is maintained and in the range of 0.1 to 1.0%, by weight $Fe_2O_3$ with the proviso that the ratio of the diameters of the first reactor and the second reactor is about 10 to 1; continuously removing a portion of the bed in second reactor to maintain therein a constant bed depth. The gases exit from the second reactor and may be condensed to recover the $TiCl_4$ or preferably be allowed to flow back and commingle with gases from the first stage and be treated to recover the chlorine values as disclosed in my U.S. Pat. No. 3,865,920.

BRIEF DESCRIPTION OF THE DRAWINGS

FIG. 2 is a graphical representation showing the chlorine losses to $TiCl_4$ from a 33" bubbling depth titaniferous ore-coke mixture at 1050° C. fed by 80% chlorine and 20% nitrogen mixture which fluidizes the bed at 0.5 ft./sec. The selected operation point for Stage 1 is shown to be 0.035 $Fe/TiO_2$. However, the operating point for Stage 1 is not limited to that value but is preferably 1.0 to 10% $Fe/TiO_2$, 6–8%, preferably, or more. Preferred for weathered beach sand ilmenites is 2 to 4% Fe because it produces essentially a replacement product and most preferred the bed iron content is 3 to 4% Fe for average weathered beach sand ilmenites. Stage 2 operation for all of the ilmenites should have an iron concentration preferably 0.1 to 1.0% and most preferably 0.5 to 0.8%.

DESCRIPTION OF THE INVENTION

I have discovered that by operating a second stage of beneficiation under about the same chlorinating conditions as a first stage but utilizing the overflow from the first stage (first reactor) held for a much shorter time in the second stage (second reactor), i.e., the second beneficiator having a lower retention time, that I can achieve low iron concentration in the product with acceptable Ti losses. The second stage is conducted under fluidizing condition with the reactor bed having approximately the same depth but a much smaller diameter than the first stage. This second smaller reactor is sometimes referred to herein as the "peanut" reactor because of its much smaller size relative to the first reactor.

The process is conducted by maintaining the concentration of iron in the first stage higher than that in the second or "peanut" stage, the amount of coke well in excess of the amount needed to react with the iron oxide in the ore. In the second reactor the coke concentration is about the same or slightly larger than in the first reactor. Since the iron concentration is lower in the second reactor, the percentage chlorine loss to $TiCl_4$ can be much higher.

Figure 1:
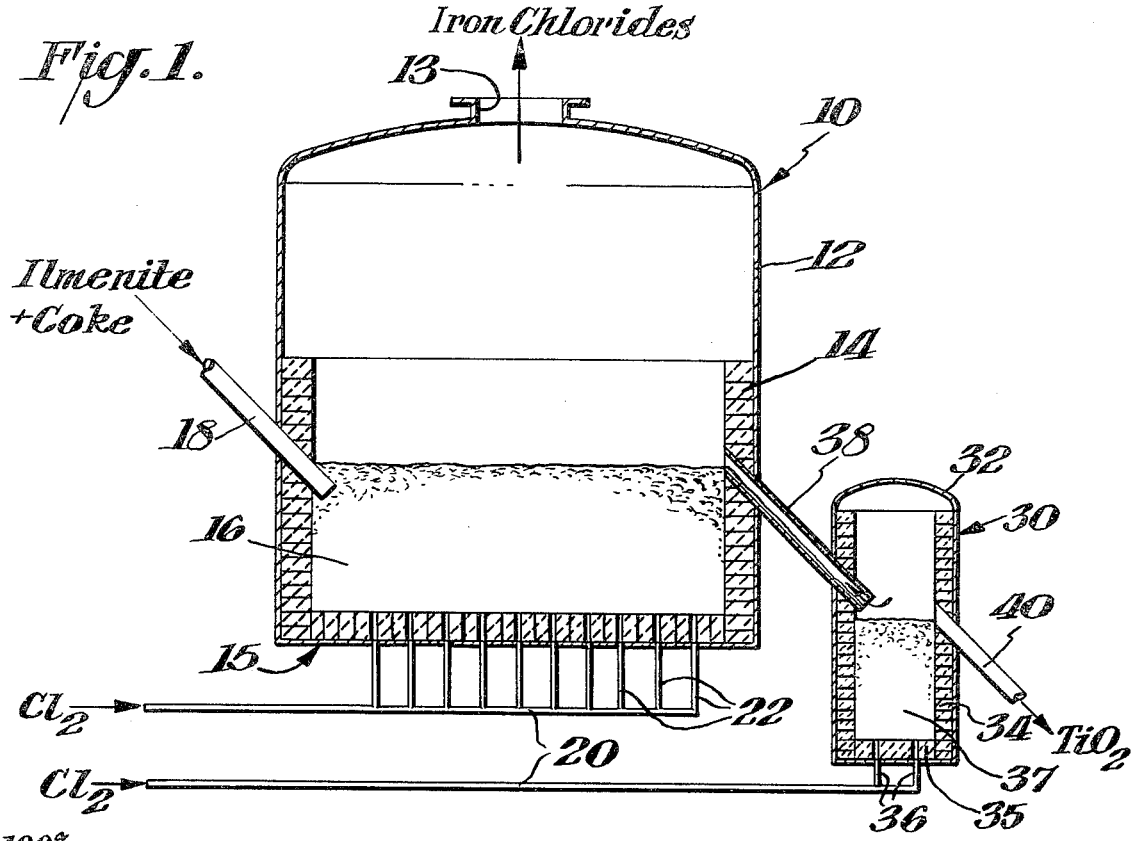
FIG. 1 is a cross-section of the reactors which are not necessarily drawn to proportion.
Figure 1:
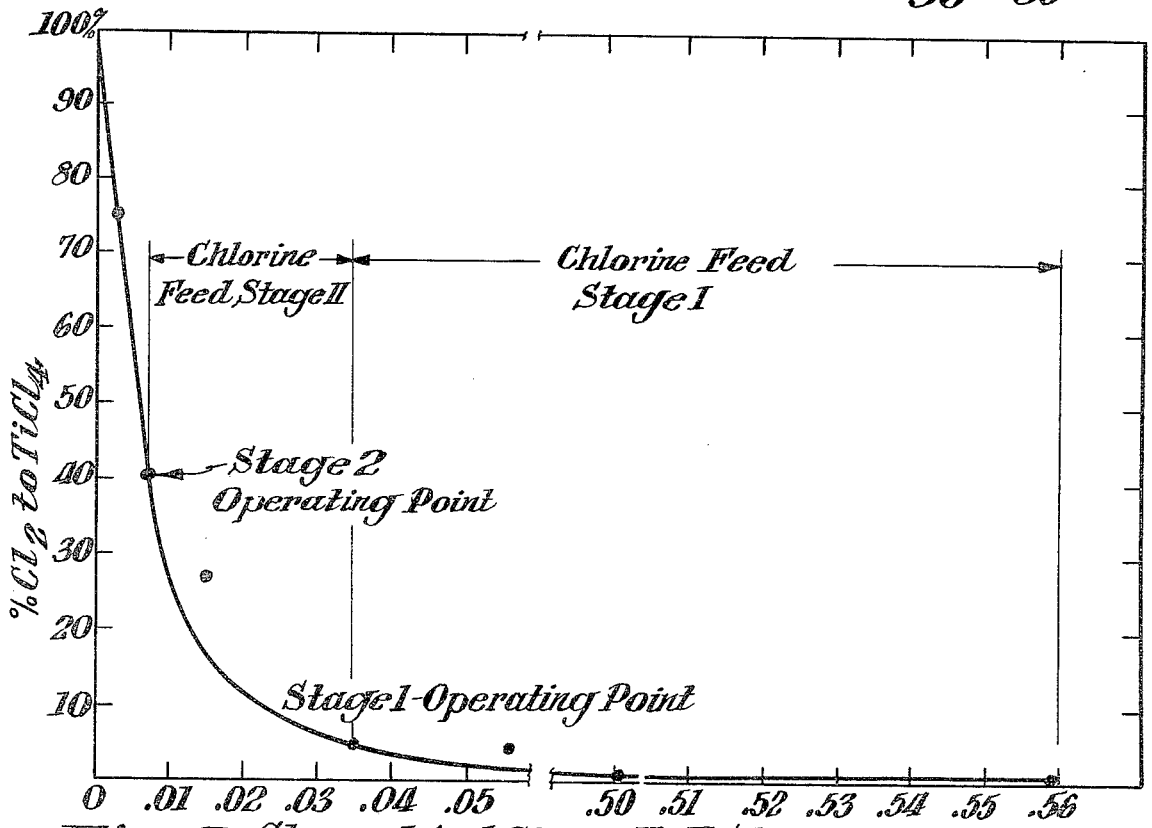

The "peanut" reactor is sized to operate so that a a significant portion of the chlorine fed to it reacts to make $TiCl_4$ most of which breaks through the bed. FIG. 1 shows the relationship between the first and second reactors where solids overflow and gases return to the space above the first stage where they commingle with the gases arising from the large first stage beneficiator bed. The $TiCl_4$ produced in stage 2 is an insignificant fraction of the total gases and is an insignificant fraction of the total titanium of the ore beneficiated. Consequently, the overall loss of titanium value as $TiCl_4$ from stage 2 at the lower iron operating point which in relation to the total amount of product obtained is not a serious loss of titaniferous values compared to a process using only one stage operating at the same iron product concentrate. My staged process thus provides an economically acceptable raw material (titania) loss and yet produces a product of acceptably low residual iron.

In FIG. 2 it is shown that the amount of chlorine fed to stage 1 produces very little $TiCl_4$ until the ratio of $Fe/TiO_2$ in the bed approaches a range below about 0.05 to 0.02%.

In my process, fresh ore mixed with carbon or fresh ore, recycle beneficiaries and carbon is continuously fed into the first reactor bed. The bed flows continuously into Stage 2, maintaining constant bed depths in both stages. The preferred $Fe/TiO_2$ ratio for Stage 2 as shown in FIG. 2 is about 0.009 producing a product having about 1.0%, by weight, iron as $Fe_2O_3$. An operating point in the range of about 0.008 to 0.015 is operative but at the larger ratio the product produced contains a larger quantity of iron oxide and at the lower ratio more titanium values are lost as $TiCl_4$.

The equipment used to beneficiate the titaniferous ore has been described in my patent, U.S. Pat. No. 3,865,920, except that the use of a second "peanut" reactor has not been disclosed. The equipment consists of a conventional gas-solids reactor as shown in FIG. 1 where the reactor 10 is constructed of steel 12 having an inlet port 18 for adding the titaniferous ore such as ilmenite mixed with particulate coke. The reactor has an outlet 13 for exiting of iron chlorides, unreacted chlorine, combustion gases such as carbon dioxide and carbon monoxide, diluent gases and titanium tetrachloride. The lower internal portion of the reactor is lined with a refractory or ceramic lining 14 consisting of refractory bricks. The base of the reactor consists of a distribution plate 15 upon which rests a bed 16 of ore-coke mixture which is held during the beneficiation reaction to a temperature of about 900° to 1090° C. preferably 1020° to 1060° C. The distribution plate is connected with a manifold 20 having inlets 22 connected with the distribution plate and leading beneath the bed for the injection into the bed of chlorine, oxygen, air, diluent gases such as nitrogen or carbon dioxide or mixtures of the same. The reactor is equipped with a side outlet pipe 38 located in the side of the reactor as an overflow for the fluidized bed of ore-coke. This side outlet pipe is connected to the second stage reactor called the "peanut" reactor and is the inlet pipe in the "peanut" reactor for introducing therein solid feed. The pipe 38 serves to conduct chlorine, $TiCl_4$, combustion gases and iron chloride vapors from the peanut reactor to the first reactor for exiting and to transport the partially beneficiated product of the first reactor having a composition of the bed operating point. Similar to the first reactor except for size, the peanut reactor is constructed of a mild or stainless steel vessel 32 having a refractory or ceramic liner 34, a distribution plate 35 which holds the bed or ore-coke 37 from the first reactor. Chlorine, either mixed or along with oxygen, air or diluent gases such as nitrogen or carbon dioxide, is passed into the bottom of the reactor by means of the manifold 36. A mixture of the product, unreacted coke, overflows from the reactor by means of outlet pipe 40 to be cooled and the carbon separated from low iron oxide containing the beneficiated product. Carbon can be separated by means of an air table. The peanut reactor does not have a separate exit port for vaporized iron chloride and combustion gases other than the inlet pipe 38 which serves as a means of transporting bedmaterial from Stage 1 to Stage 2 and as an outlet for reaction gases from Stage 2 which are mixed with the reaction gases of Stage 1 and exited by means of outlet 13. Both reactor shells can be water-cooled.

The ratio of the diameters of the Stage 1 reactor to the Stage 2 reactor varies from 10:1, but the ratio preferably is 7.5 to 1 and to 5 to 1 which is most preferred, however, the ratio is 3 to 1.

Stated in another way, the ratio of the volume of the bed in Stage 1 to the volume of the bed in stage 2 varies 100 to 1 and preferably 50 to 10 and most preferred 30 to 20.

Both stages can be heated either by external means or by ignition of some of the carbon in the bed with air or oxygen added to the chlorine (along with diluent gas) to a temperature in the range of 900° to 1090° C. with 1020° to 1060° C. being preferred. The static bed depth in both stages is in the range of 1.5 to 7 feet with 2.5 to 4 feet being preferred. The rate of flow of chlorine either alone or mixed with a diluent gas or with air or oxygen or air or oxygen with a diluent gas such as nitrogen or carbon dioxide is in the range of 0.25 to 1.25 ft./sec. and is the rate sufficient to maintain the bed in a fluidized state and is dependent upon the depth of the bed and the particle size distribution of the bed. The ore and carbon used are particulate. The particle size range of the ore is 60 to 200 mesh and the particle size range of the carbon is 4 to 44 mesh. The carbon used preferably is a heard petroleum coke or a bituminous coke having a low hydrogen contact. The preferred surface area of the carbon is 10–15 ft./lb.

The product produced in Stage 2 can be cooled in a cooler or by means of a transfer leg (not shown) or dumped on the ground for cooling.

The retention time for the ore in the reactors is directly related as the areas of depth of the two beds and for the larger reactor is in the range of 0.5 to 2.0 hr., preferably 1.0 to 2.0 hr. and most preferred 1 hour.

EXAMPLE I

A reactor having an internal diameter of 7 feet lined with 9" of refractory brick and a multipoint refractory distributor is continuously fed pre-heated ore and coke to form a 23" static bed. Excess $Cl_2$ is injected into the ore at a rate sufficient to fluidize the bed. At intervals, the reactor is sampled by drawing vacuum bulb samples from the exit gas stream above the bed. After shutting off gas flows the bed material was sampled by a 4" stainless steel sample pot on a chain. The reactor was operated at 1050° C. with 152 $ScfmCl_2$ and 35 $ScfmN_2$ at time of sampling.

The bed contained Great Lakes Petroleum Coke in amounts, average particle size and specific areas as shown in Table 1.

The bed, of composition similar to normal "peanut" composition, was sampled by direct sampling after gas samples were taken from overhead gases by an evacuated gas pipette drawing in from a direct stream escaping to the atmosphere through a 1" diameter orifice. Sample bulb volumes were between one and two liters with gas entering through a 10 mm stopcock turned full open, and held open for 5 seconds. Table 1 gives the analyzed contents and calculated % $Cl_2$ to $TiCl_4$ of one group of samples. Table II gives the bed and magnetic spectrum analyses of coke free bed samples separated on a laboratory roll magnetic separator.

TABLE 1

| Sample | Fe++ | $Fe^T$ | $TiO_2$ | % $Cl_2$ to $TiCl_4$ |
|---|---|---|---|---|
| 1 | .105 | .400 | .161 | 29 |
| 2 | .143 | .515 | .167 | 25.1 |
| 3 | .135 | .490 | .133 | 27.5 |

*$TiCl_4$ reported as $TiO_2$;
$Fe^{++}$ is soluble ferrous iron and $Fe^T$ total soluble iron.
The % $Cl_2$ to $TiCl_4$ does not consider chlorine values to other metal oxides.

TABLE II

Peanut Beneficiator Bed Analysis - Example I

Coke: 23.75% by wt.;
Specific Area: 9.10 $ft^2$/lb;
Av. Size: 1425 microns.

| Non-Mag at | wt % | % $Fe^T$ | Cumulative wt | % $TiO_2$ |
|---|---|---|---|---|
| 8.0 amps | 51.90 | .7 | 51.90 | 96.48 |
| 7.0 | 15.42 | .8 | 67.32 | 97.2 |
| 6.0 | 8.16 | .8 | 75.48 | 96.96 |
| 5.0 | 4.82 | .9 | 80.30 | 96.72 |
| 4.0 | 3.18 | 1.0 | 83.48 | 96.96 |
| 3.0 | 1.74 | 1.5 | 85.22 | 94.54 |
| 2.0 | 2.67 | 4.10 | 87.89 | 93.54 |
| 1.0 | 5.17 | 7.10 | 93.06 | 88.48 |
| 0 | 5.77 | 9.25 | 98.83 | 84.11 |
| Mag O | 1.17 | 9.00 | 100.00 | 84.36 |

Bulk density of the product was 2.08 g./cc.

The magnetic fractions were cut from the samples by taking out the non-magnetic fraction and repassing it over the roll at the same amperage and then proceeding to the next lower amperage to separate the next more magnetic fraction.

EXAMPLE II

The beneficiator of Example 1 was operated at a lower iron content and sampled to determine $TiCl_4$ losses in the gas corresponding to the bed iron content. The Pilot Plant reactor would correspond in size to a typical Peanut stage for a 100,000 ton per year beneficiate plant.

Table 3 and 4 give gas and bed analysis at the lower iron operating point.

TABLE III

Gas Analysis for Peanut Beneficiation Stage

| Sample | $Cl_2$ | Fe++ | $Fe^T$ | $TiO_2$ | % $Cl_2$ loss to $TiCl_4$ |
|---|---|---|---|---|---|
| 1 | .004 | .035 | .085 | .303 | 79 |
| 2 | .004 | .025 | .068 | .327 | 84 |
| 3 | 0 | .023 | .065 | .121 | 64 |

TABLE IV

Bed Analysis and Composition

Coke: 21.98%, 8.69 $Ft^2$/lb. 1492 Micron Av. Size

| Beneficiate: | Fe++ | $Fe^T$ | $TiO_2$ |
|---|---|---|---|
| | .1 | .3 | 96.23 |

EXAMPLE III

The beneficiator having a diameter of 7 feet of Example I was used as the first stage and the product produced therein and overflowed into a small beneficiator of 1.13 diameter made of a stainless steel shell and 4" refractory lining with multipoint distributor. The Stages 1 and 2 overflow pipes were watercooled; and equipped with sample pipes to take hot ore samples. Chlorine was injected into the peanut at a rate of 12–15 scfm. and a mixture of $N_2$ and $O_2$ was added to maintain heat balance.

The Stage 1 overflow to the "peanut" was detectable by a thermocouple extending horizontally into the bed. Overflow from the peanut could be detected by a temperature rise in the beneficiate cooler.

By sampling, differences of 2–4% in iron levels between beneficiator and peanut were observed, and one could maintain heat balance and vary reaction temperatures within a 900°–1075° C. range by $O_2$ addition to the smaller reactor.

It is, of course, possible where small amounts of $TiCl_4$ and low iron levels are desired to suppress the $TiCl_4$ loss by addition of fresh dried ilmenite to the "peanut" and re-separate this small amount by the magnetic recycle. This technique is of value in reducing the $TiO_2$ lost to the iron oxide, particularly when the iron oxide is a valuable saleable by-product.

The amount of partially beneficiated magnetics recycled to the small peanut beneficiator would be reduced in weight over the magnetic recycle stream needed without "peanut" operation since the high $Fe/TiO_2$ would allow a smaller total recycle weight to place the peanut operating point back to near the zero $TiCl_4$ loss position; producing, in effect, use a double recycle.

When the magnetic recycle streams are of high iron concentration, recycle to both reactors is possible. This cold feed to the "peanut" will have heat balance advantages as the peanut reactor is scaled to plant size. At full plant scale of 100,000 tons/year, stage 1, the peanut would have a diameter of 20 to 22 feet and be about 5–6" in diameter. With an input feed overflowing from the first stage at 1050° C. and the heat of reaction in the peanut, it is advisable to add to the "peanut" cold solids or other cooling for heat balance.

Using the experimental data of Example I, the advantage of "peanut" stage operation over single stage beneficiation to produce the same product, we have:

Incoming Feed: $Fe/TiO_2$ = .56 wt ratio
.80 mol ratio

Using the 1st stage operating point as 4% Fe (0.057 mol ratio) with a bed depth of 4 ft. (static) which is sufficient to give 0.5% $TiCl_4$ loss and 95% $FeCl_2$, the Stage 1 will consume ($Cl_2$/mol of $TiO_2$ fed) equal to:

$.8[.95 + (.05 \cdot 1.5)]$ = .82 mols $Cl_2$ to iron chlorides
.01 mols $Cl_2$ to $TiCl_4$ -continued

| |
|---|
| .83 mols $Cl_2$/ mol $TiO_2$ fed |

Choosing the second stage operating point as in Example I

| | |
|---|---|
| % Fe = .177 $TiO_2$ = 95% therefore Fe/$TiO_2$ = | 1.86 wt ratio<br>2.66 mol ratio |

The output gases had an iron chloride ratio of $(Fe^{++}/Fe^{T})=0.27$

The amount of Fe and Ti removed is:

$(0.057-0.0266)=0.0304$ mols Fe/mol $TiO_2$ and uses $[0.27+1.5\ (0.73)]=1.365$ mols $Cl_2$/mol Fe removed. Since 27.2% of $Cl_2$ is lost to $TiCl_4$, the loss is:

$$\frac{(.0304)\ (1,365)}{(1-.272)} = .057 \text{ mols } Cl_2/\text{mol of } TiO_2 \text{ fed}$$

and the loss to $TiCl_4$ would be:

$$(0.3040)\ (1.365)\ (0.272)=0.01129 \text{ mols } Cl_2/\text{mol } TiO_2$$

Therefore, using staged reactors the amount of chlorine used is as follows:

| | | |
|---|---|---|
| Stage 1 | $Cl_2$/mol $TiO_2$ fed | = .83 |
| | $Cl_2$ to $TiCl_4$ | = .01 |
| Stage 2 | $Cl_2$/mol $TiO_2$ | = .057 |
| | $Cl_2$ to $TiCl_4$ | = .011 |

the mols $Cl_2$ to $TiCl_4$/mol of $TiO_2$ product $$\frac{.021}{1-.0105} = .021$$

which represents a loss of about 1.0% of total titanium values.

Single Stage Operation:

Mols iron removed/mol $TiO_2$ fed (.8 − .0266) = .7734

Chlorine used for iron removal (.7734) (1.365) = 1.0557

Total $Cl_2$ used /mol $TiO_2$ fed $\frac{1.0557}{(1-.272)} = 1.450$

Mols $Cl_2$ to $TiCl_4$ (1.450) .272 = .3944

These would be a $TiCl_4$ loss of $\frac{.3944}{.2} = .197$ mols $TiCl_4$/mol $TiO_2$ fed So on a product basis one would lose $\frac{.3944}{.803} = .49$ mols $Cl_2$/mol $TiO_2$ product Comparing:

| | Mols $Cl_2$ to $TiCl_4$ / mol Product | $TiO_2$ loss / mol Product $TiO_2$ | % lost |
|---|---|---|---|
| Peanut Added | .021 | .01 | 1.0 |
| Single Stage | .49 | .245 | 24.5 |

These calculations have been made with experimental values not optimized, but they illustrate that significant reduction in iron content of product beneficiate can be achieved with relatively small losses of $TiO_2$ using my novel process. The dust losses from fluidized bed motion at typical beneficiator operating velocities will run 1-2% and these are not considered in the calculations.

The "peanut" can be used to advantage in direct coupled systems where beneficiate flows directly to the chlorination stage without coke separation where a recycle magnetic system for separating partially beneficiated product high iron oxide containing particles of ore from the product which is coke recycled to stage separation refeeding and preheating.

A great many combinations and operating conditions are possible to operate the "peanut" reactor to achieve the optimum iron level and minimize $TiCl_4$ production. It is the purpose of this invention to show how by the use of a small second stage with an acceptable $TiCl_4$ loss one can beneficiate to produce a product with extremely low iron levels without losing high percentages of titanium values. The peanut reactor need not operate at the same temperature, bed depth and chlorine flow rate as Stage 1 since different conditions can be conducted in either reactor.

I claim:

1. A process for beneficiation of a titaniferous ore to a polycrystalling rutile having a low iron oxide content without the loss of appreciable titanium values as titanium tetrachloride comprising continuously adding a mixture of a particulate, titaniferous ore and carbon to a first stage gas-solids reactor containing a preformed bed of a partially beneficiated ore comprising particulate titaniferous ore and 10 to 25%, by weight, particulate carbon, said bed having an iron oxide content of 5%, by weight, calculated as $Fe_2O_3$, said bed having a temperature of 900° to 1090° C., continuously injecting into the bed a gas selected from the group consisting of chlorine, chlorine and oxygen, chlorine and air, chlorine, oxygen and diluent gas, and chlorine, air and diluent gas, at a rate whereby in the first reactor the temperature is maintained, the bed is fluidized and iron oxide in the titaniferous ore is converted into iron chloride vapor, the iron content of the bed is maintained, and less than 2% of the chlorine values are converted to escaping $TiCl_4$; continuously transporting a portion of the bed of the first reactor to a second stage reactor at a rate which maintains constant bed depth in the first reactor, with the proviso that the ratio of the diameters of the first reactor and the second reactor is in the range of 10 to 1, said second reactor containing therein a bed of particulate partially beneficiated ore and carbon wherein the iron content of the ore is in the range of 0.1-1.0%, by weight, calculated as $Fe_2O_3$; said second reactor bed having a temperature of 900° to 1090° C.; continuously injecting into the bed in the second reactor a reaction gas selected from the group consisting of chlorine, chlorine and oxygen, chlorine and air, chlorine, oxygen and a diluent gas, and chlorine, air and a diluent gas wherein:

(i) said temperature in the second reactor is is maintained, (ii) the bed is fluidized, (iii) iron oxide in the partially beneficiated ore is converted to an iron chloride vapor, (iv) simultaneously with the formation of iron chlorides substantial quantities of $TiCl_4$ are formed, (v) maintaining the iron content of the bed in the second reactor and in the range of 0.1 to 1.0%, by weight $Fe_2O_3$, and (vi) continuously removing a portion of the bed in second reactor to maintain therein a constant bed depth.

2. The process of claim 1 wherein the ratio of the diameters of the first reactor to the second reactor varies 7.5 to 1.

3. The process of claim 1 wherein the ratio of the volume of the bed in the first reactor to the volume of the bed in the second reactor varies 100 to 1.

4. The process of claim 3 wherein the ratio of the volume of the bed in the first reactor to the volume of the bed in the second reactor varies 50 to 10.

* * * * *